United States Patent [19]

Wheeler

[11] Patent Number: 4,886,007

[45] Date of Patent: Dec. 12, 1989

[54] SERVOMECHANISM FOR SAILBOATS

[76] Inventor: Robert L. Wheeler, 823-A E. Gulf Blvd., Indian Rocks Beach, Fla. 34635

[21] Appl. No.: 224,644

[22] Filed: Jul. 27, 1988

[51] Int. Cl.[4] ..... B63H 9/10

[52] U.S. Cl. ..... 114/102; 73/188; 114/39.1; 114/144 C

[58] Field of Search ..... 114/39.1, 102–104, 114/144 C; 73/188; 254/272, 273

[56] References Cited

U.S. PATENT DOCUMENTS 4,040,374 8/1977 Greene ..... 114/144 C 4,671,201 6/1987 Yokoyama ..... 114/102

*Primary Examiner*—Joseph F. Peters, Jr.
*Assistant Examiner*—Jesus D. Sotelo
*Attorney, Agent, or Firm*—Joseph C. Mason, Jr.; Ronald E. Smith

[57] ABSTRACT

Apparatus that maintains a sailboat sail in a position where maximum power is derived from the wind. The apparatus includes a wind vane that responds to directional changes in the wind and sends an electrical signal to a motor that adjusts sail-positioning lines as needed. The new position of the sail is communicated to the wind vane and the motor is shut off.

22 Claims, 4 Drawing Sheets

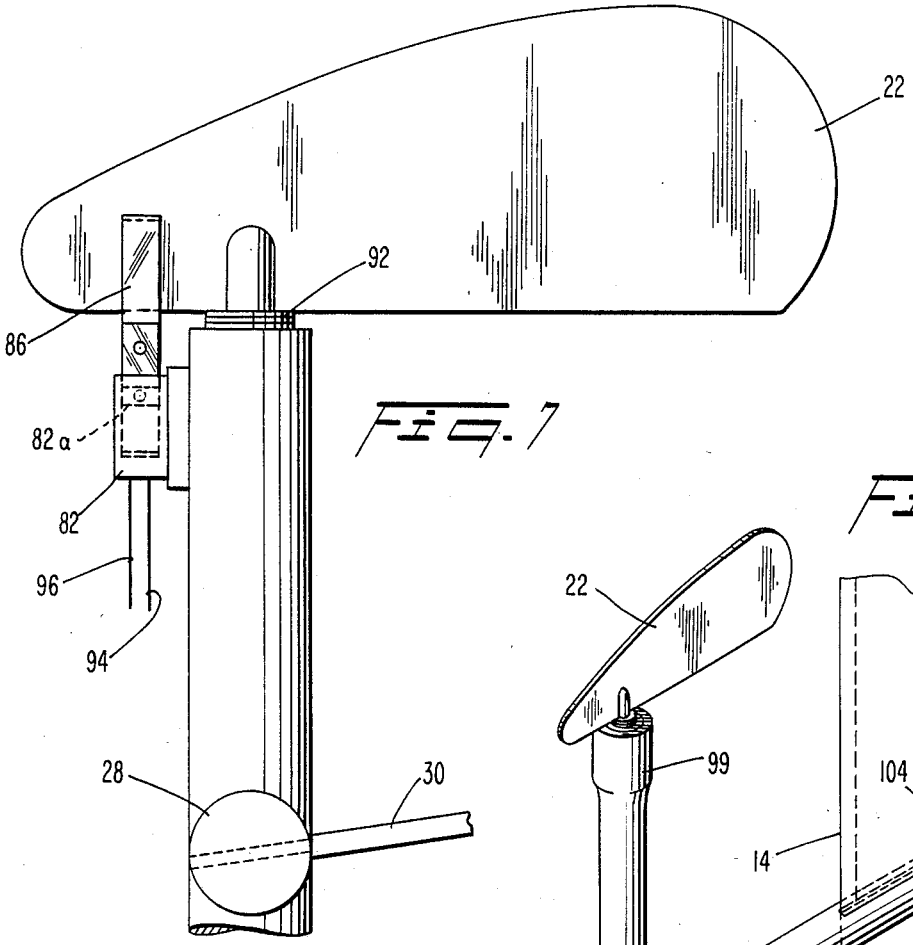
Fig. 7
Fig. 8
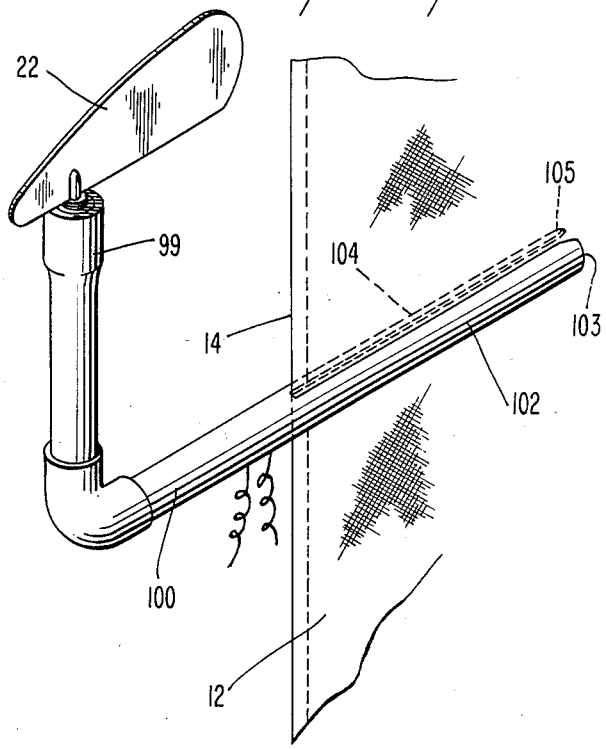
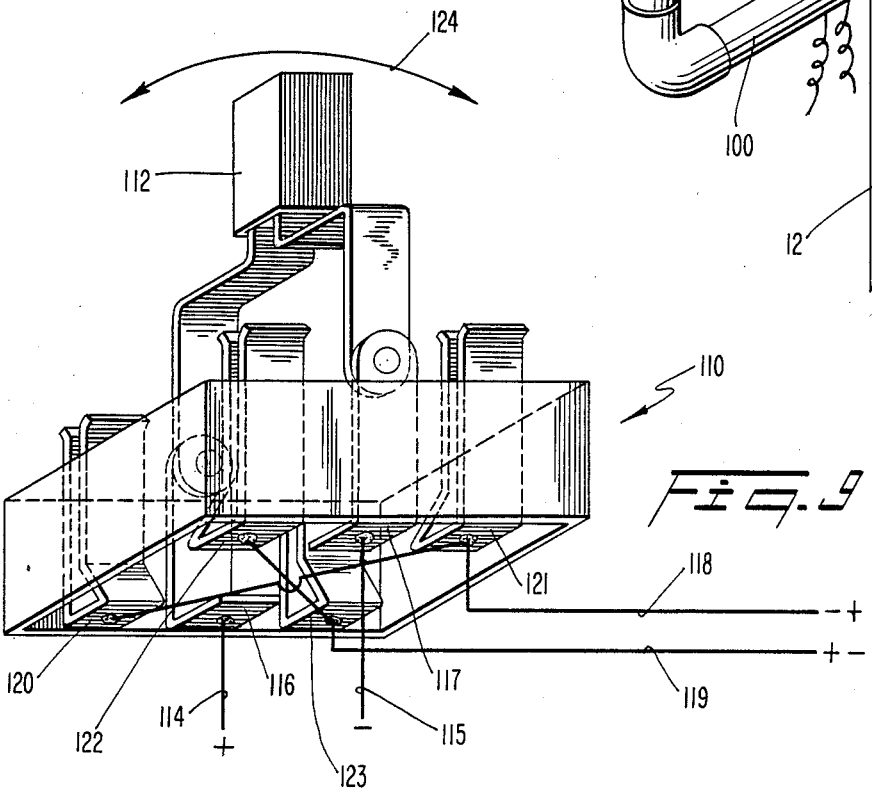
Fig. 9

FIG. 10
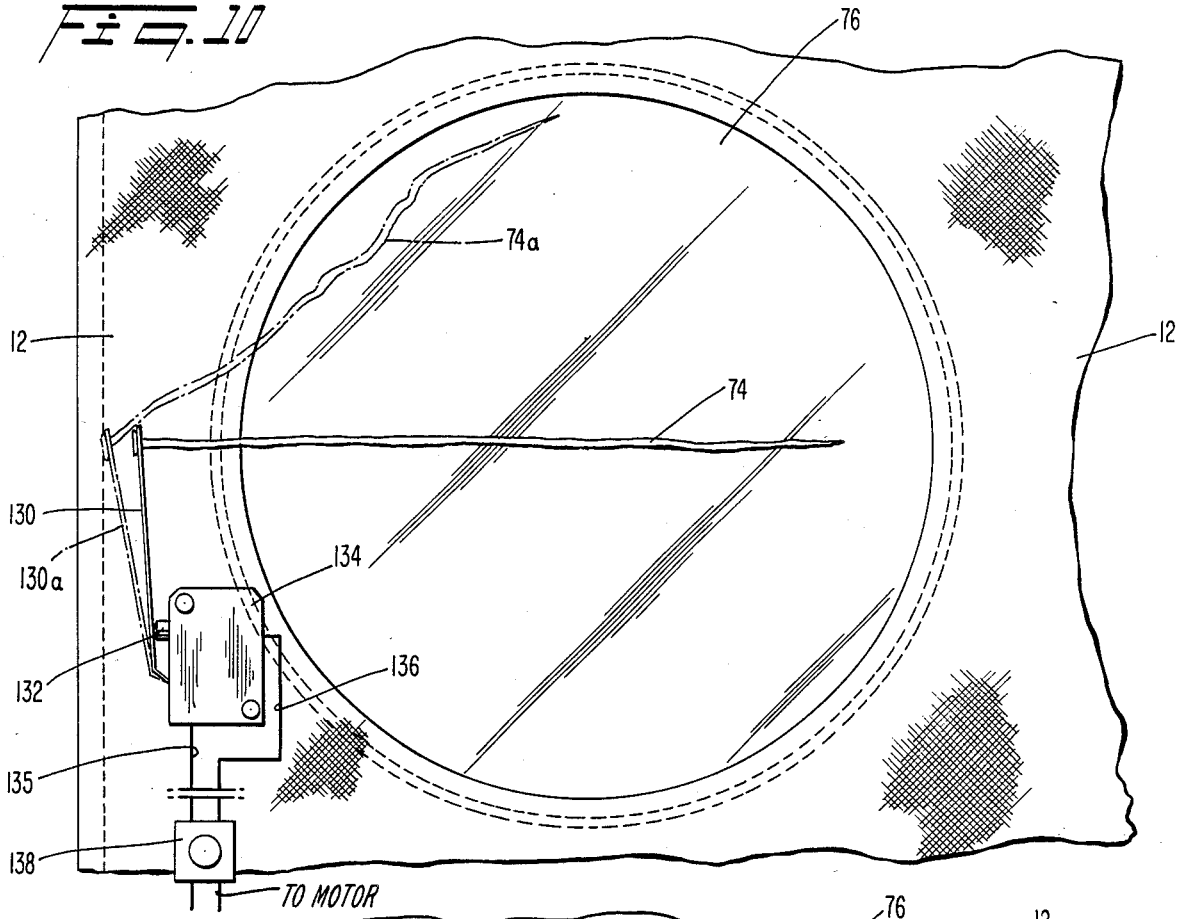
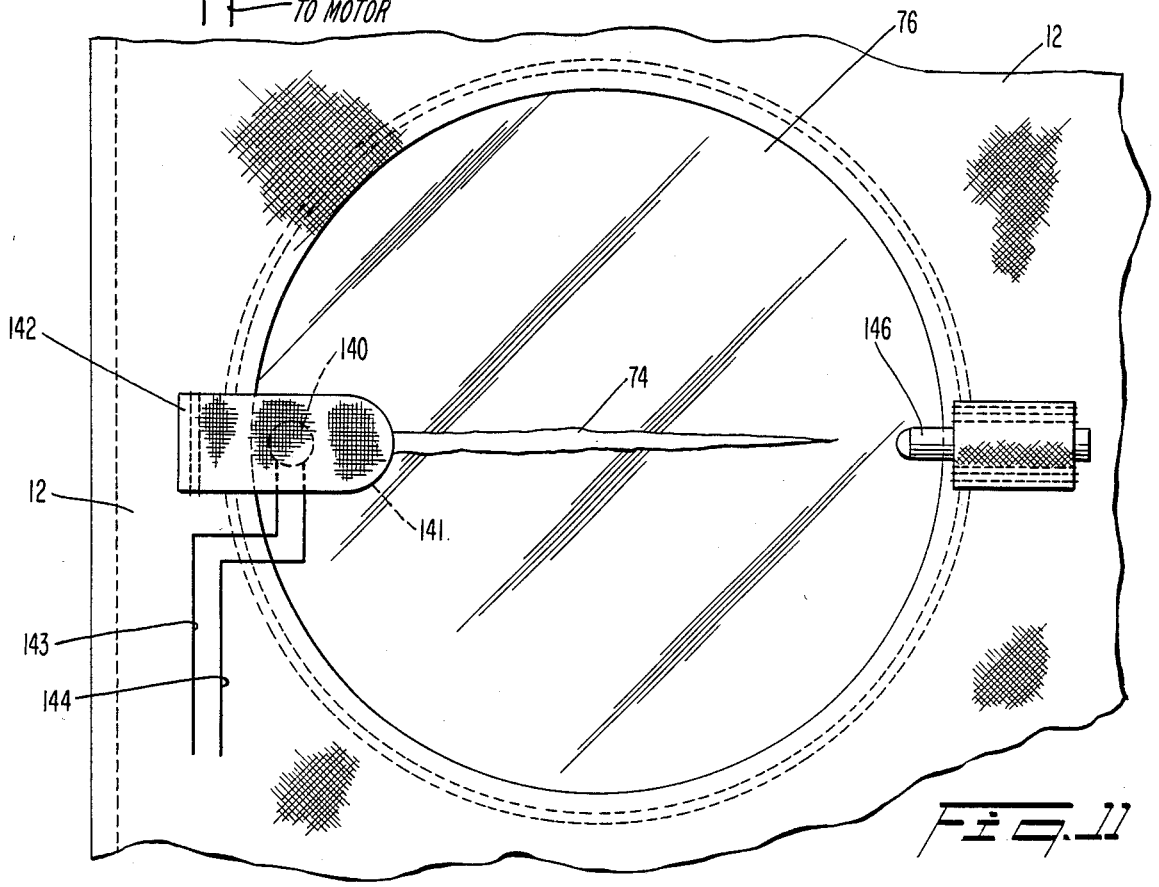
FIG. 11

SERVOMECHANISM FOR SAILBOATS

TECHNICAL FIELD

This invention relates, generally, to devices that automatically adjust the sails of a sailboat in response to relative wind or course changes. More particularly, it relates to a servomechanism that includes a motor means that receives input information from a wind vane and that repositions the sail to provide input information into the wind vane.

BACKGROUND ART

In order to obtain maximum power from the wind, it is necessary to properly adjust the angular position of a sailboat's jib or other thrust-providing sail.

Once the sail has been positioned as desired, no further repositioning of the sail is needed as long as the direction or velocity of the wind does not change and as long as the course of the boat is not changed.

In actual boating, relative wind and course changes are common. Thus, the operator of the boat is kept quite busy readjusting the angular position of the sail to the new conditions. Although novice sailors may at first enjoy the continual work required to keep the sail in proper trim, experienced sailors prefer to spend their time enjoying the cruise itself.

Few, if any, attempts have been made to design automatic sail trimming devices. Most prior art efforts have been directed, instead, to automatic means for steering boats by adjusting the rudder of a boat. The present inventor is aware of the following United States Patents in the field of this invention:

| U.S. Pat No. | Patentee | Date |
|---|---|---|
| 4,193,432 | Schuster | 1980 |
| 4,314,518 | Marsden | 1982 |
| 4,165,704 | West, Jr. | 1979 |
| 3,903,828 | Green | 1975 |
| 4,040,374 | Greene | 1977 |
| 3,180,298 | Gianoli | 1965 |
| 2,653,563 | Long | 1953 |
| 4,366,767 | Knoos | 1983 |
| 2,519,469 | Grierson | 1985 |
| 4,066,911 | Sarchet | 1978 |

It has also been reported in the press that computers have been installed aboard large sailboats; the computers simply monitor wind and other information and display the information on a screen.

A need persists for an automatic sail trimming apparatus that is light in weight and affordable by the average sailboat owner. The device should be mechanically simple and easy to make and install.

Although the prior art devices fulfill their intended functions, none of them teach or suggest how an economical yet highly effective servomechanism of the type disclosed hereinafter could be provided.

DISCLOSURE OF INVENTION

A servomechanism operates to continually adjust the angular position of a sail on a sailboat so that a preselected angular orientation between a sail and a wind vane member is restored quickly whenever said angle is changed by a change in course or relative wind direction.

The sailor first positions the sail in its desired angular orientation and energizes a control means that controls activation and deactivation of a motor means. The wind vane is electrically connected to the control means so that as the direction of the wind relative to the wind vane changes, thereby changing the angle between the sail and the wind vane, the motor means is activated. Activation of the motor means effects a change in the angular position of the sail through a novel interconnection between the motor means and lines which control the sail's angular position.

When the angular position of the sail is changed by the motor means, feedback information concerning the sail's new angular position is delivered to the wind vane; when the angular relative position of the sail and wind vane are restored to their initial relative position, the motor means is deactivated.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which:

Similar reference numerals refer to similar parts throughout the several views of the drawings;

FIG. 7 is a side elevational view of the embodiment of FIG. 6;

FIG. 8 is a perspective view of an alternate wind vane mounting assembly;

FIG. 9 is a perspective view of an embodiment that does not employ a wind vane or feedback means;

FIG. 10 is a port side elevational view of the telltail section of a sail, showing an embodiment of the invention that does not employ a wind vane assembly; and FIG. 11 is a port side elevational view of still another embodiment that does not employ a wind vane assembly. Similar reference numerals refer to similar parts through the several views of the drawings.

BEST MODES FOR CARRYING OUT THE INVENTION

Figure 1:
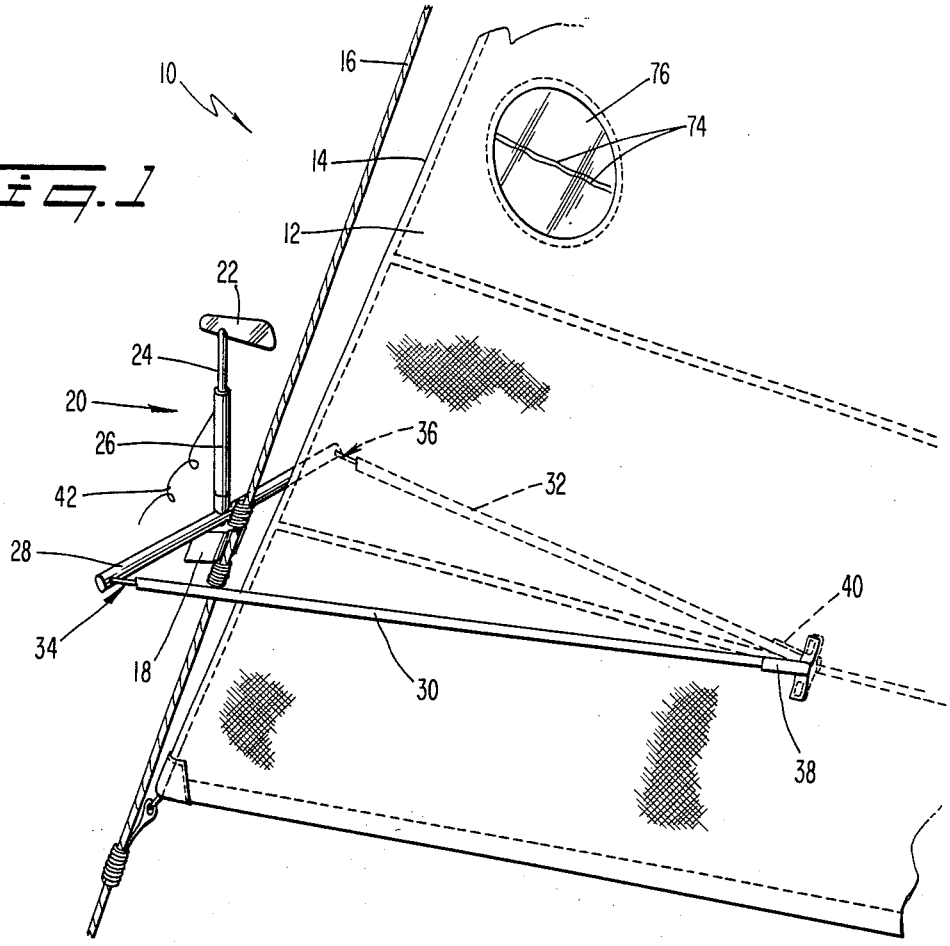
FIG. 1 is a perspective view of the forward end of a sailboat equipped with the novel apparatus.

FIG. 1 denotes the forward part or bow of a boat by the reference numeral 10, generally.

Sail 12 has a leading edge 14; a headstay 16 is optionally positioned forwardly of sail leading edge 14 as shown and serves as the preferred mounting means for mounting block 18.

Mounting block 18 and headstay 16 serve to support the wind vane assembly which is denoted by the reference numeral 20 as a whole. Alternatively, assembly 20 could be mounted onto the leading edge of sail 12 or onto the bow pulpit or other suitable location.

Wind vane assembly 20 includes a wind vane member 22 that is rotatably mounted relative to the uppermost end of upstanding sleeve member 24 so that it is free to rotate in a horizontal plane in simultaneous response to wind shifts.

Sleeve member 24 is telescopically received within and fixedly secured to sleeve member 26 having a lower end that joins a horizontally disposed crossbar member 28 in a "T" intersection as shown. Thus, sleeve members 24 and 26 could be replaced with a single sleeve member.

A pair of elongate feedback members 30, 32, which may be formed of flexible line, have their respective leading ends secured to opposite ends of crossbar 28 by suitable means denoted 34, 36, respectively, and their respective trailing ends are secured to the opposite sides of sail 12, rearwardly of the sail's luff area but forwardly of its vertical axis of symmetry, by suitable means such as a Velcro hook and loop fastening means denoted 38, 40.

Thus, feedback members 30, 32 diverge from one another along their trailing-to-leading extent, or converge toward one another along their leading-to-trailing extent, as shown.

Accordingly, an isosceles triangular configuration is formed where crossbar 28 is the base of the triangle and members 30, 32 are the sides.

Thus, rotation of sail member 12 in a horizontal plane effects like rotation of crossbar 28 and hence sleeve members 24, 26 but not wind vane 22.

Figure 2:
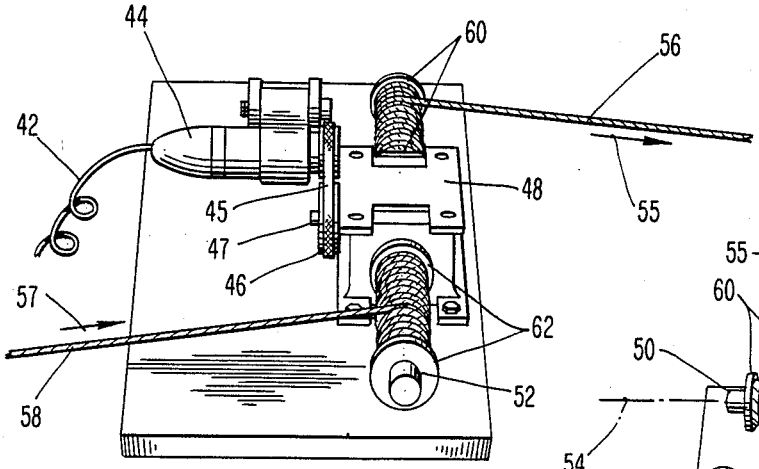
FIG. 2 is a perspective view of the motor means of this invention and its associated parts.
Figure 3:
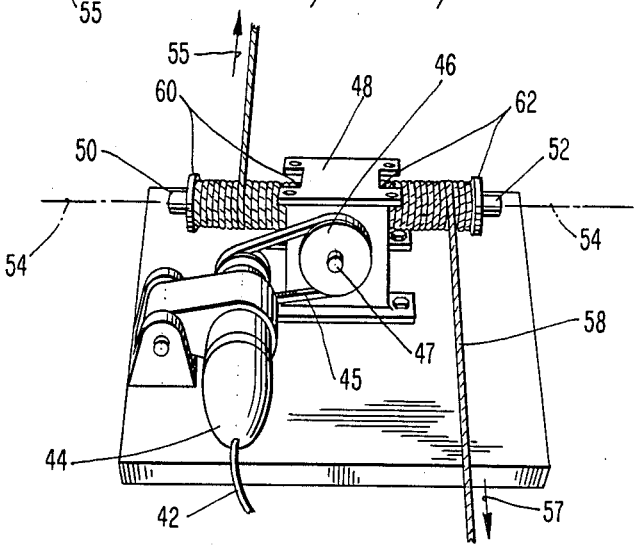
FIG. 3 is a perspective view similar to that of FIG. 2, but rotated 90 degrees.
Figure 4:
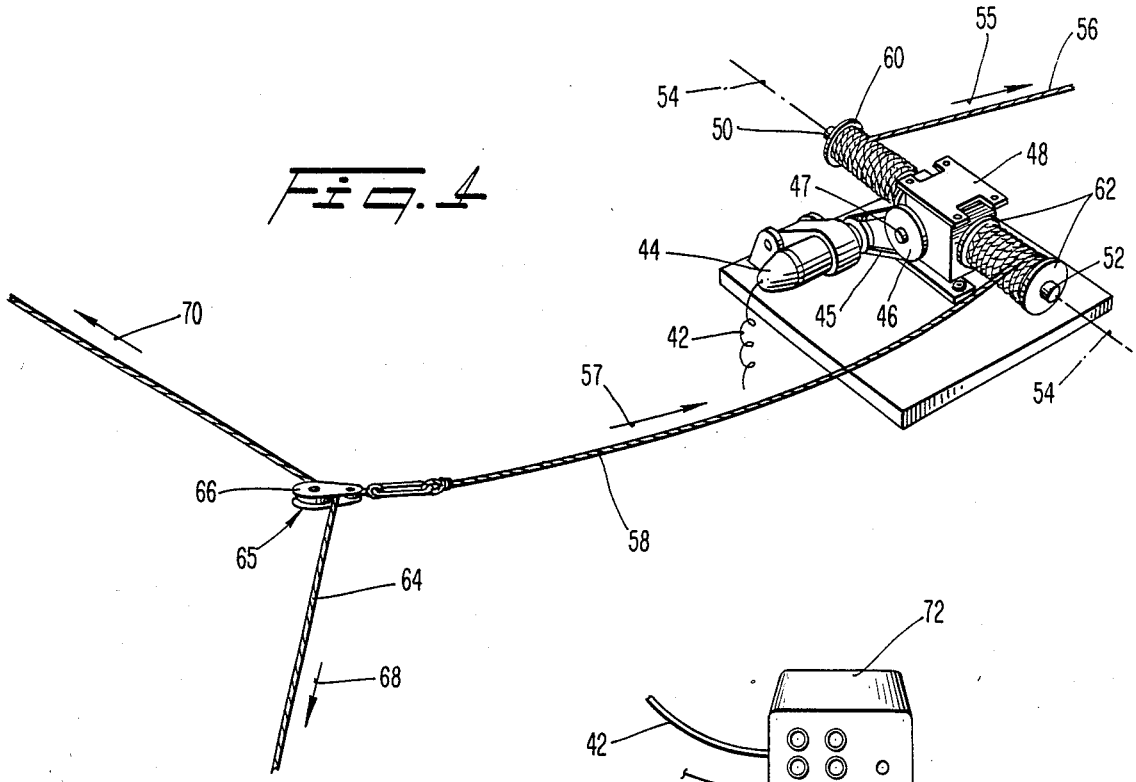
FIG. 4 is a perspective view similar to FIG. 2, but showing additional parts.

An elongate, flexible electrical cord member 42 has a first end disposed in electrical communication with sleeve 24 as shown in FIG. 1 and a second end disposed in electrical communication with a motor means 44 as depicted in FIGS. 2–4.

More specifically, sleeve 24 includes a resistor means, not shown, and wind vane 22 includes an output tap or slider means, not shown, or vice versa, thereby collectively defining a potentiometer means. Thus, relative rotation between sleeve 24 and vane 22 changes the voltage supplied to motor means 44.

Motor 44, as best shown in FIG. 3, has an output shaft connected by belt 45 to sheave 46, the rotation of which simultaneously and correspondingly effects rotation of shaft member 47.

Shaft member 47 carries gear means, not shown, which engage other gear means, also not shown, disposed interiorly of gear box or speed reducer 48.

Speed reducer 48 has dual, oppositely-extending output shaft members denoted 50, 52, both of which are driven by motor 44 and which rotate in the same direction at the same time. Thus, a single shaft could be used in lieu of the dual shafts, as will become more clear as this description proceeds.

Motor 44 and its related assembly, including speed reducer 48, is mounted substantially in the center of the sailboat, not shown.

More specifically, the common rotational axis of symmetry of shafts 50, 52, denoted 54 in FIG. 3, lies in a vertical plane that bisects the boat along its longitudinal axis of symmetry.

It should therefore be understood that flexible line members 56, 58 are transversely disposed with respect to the longitudinal axis of the boat, as best depicted in FIG. 4. Each line 56, 58 has its inner end wound about an associated shaft 50, 52 which shafts are flanged as at 60, 62 to provide a drum means, as best shown in FIG. 3.

It should be clear that rotation of the shafts 50, 52 therefore effects coiling of one of said lines 56, 58 while simultaneously effecting uncoiling of the other line as suggested by directional arrows 55, 57.

Thus, coming about, i.e., when tacking, no additional adjustment of lines 56, 58 is needed. One of said lines will always be under tension and the other will always be under slack; tacking merely switches the slacked line to tension and vice versa.

As shown in FIG. 4, the outermost end of line 58 engages a longitudinally disposed line 64; specifically, sheave 65 rollingly engages line 64 and a sheave housing 66 maintains said engagement. When line 58 is pulled toward the boat's centerline as indicated by directional arrow 57, line 64 is constrained to follow it as shown; the counterpart of line 64, disposed on the opposite side of the boat, will be slack at the time as indicated by arrow 55.

The forward end of line 64 passes through a sheet block and is secured to a sail at the forward end of the boat, as suggested by directional arrow 68; the opposite end of line 64 is secured to a winch, not shown, at the aft end of the boat, as suggested by directional arrow 70.

A line similar to line 64 runs the longitudinal extent of the boat on the opposite side thereof as aforesaid, but is not shown; said other line also has its leading end secured to the same sail and its trailing end secured to a winch or other mounting member in a conventional manner.

Those familiar with sailboat construction will thus recognize line 64 and its counterpart as jib sheets; sails other than jibs may be controlled in a similar fashion by the novel apparatus.

Jib sheets (lines) are the lines which are manipulated to adjust the angular orientation of jib (or other sail) 12. More specifically, on boats not equipped with the inventive apparatus, the angular disposition of the sail is adjusted by cranking the winches or by otherwise pulling on or releasing the jib sheets.

In a boat equipped with the novel apparatus, however, the inward or outward travel of lines 58 or 56 will effect the desired adjustment as should be clear from FIG. 4.

Motor 44, as mentioned earlier, receives its electrical input from wind vane 22; the output shaft of motor 44 will thus rotate clockwise or counterclockwise, depending upon the relative rotation between sleeve 24 and wind vane 22, as aforesaid, which rotation will cause either line 64 or its counterpart to travel inwardly or outwardly at its midpoint as shown in FIG. 4.

Figure 5:
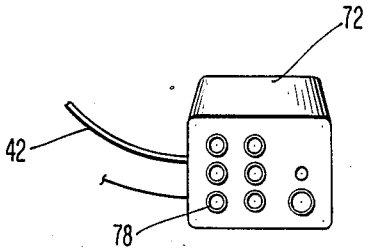
FIG. 5 is a perspective view of a control panel.

FIG. 5 shows a suitable control box 72 for motor 44. A wind vane, control box and motor that have been found acceptable are made by Nautech Limited, Anchorage Park, Portsmouth, Hampshire, PO 35 TD, England, and sold under the marks Autohelm 3000 and Autohelm 6000. The Nautech components are employed in the prior art as a part of autopilot means for rudders.

Figure 6:
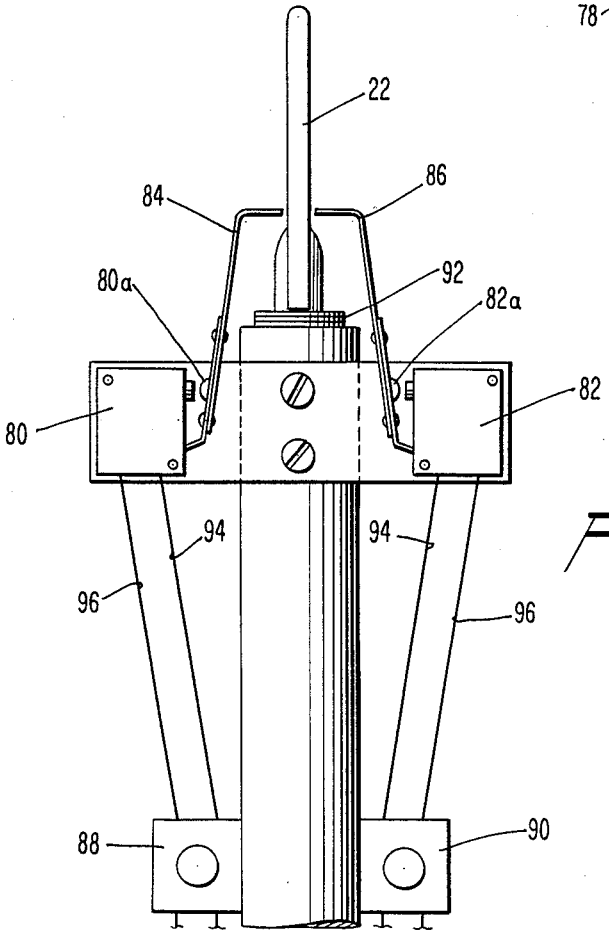
FIG. 6 is a front elevational view of an alternate embodiment.

In an alternative embodiment of the invention, shown in FIGS. 6 and 7, control box 72 is eliminated, and instead of using an autopilot motor means, a standard motor is used. The potentiometer means is also eliminated. Microswitches 80, 82, having outwardly biased, depressable switch means **80*a*, 82*a*, are placed on opposite sides of wind vane 22 and are closed by flexible switch activator means 84, 86 when the wind vane rotates out of its predetermined home orientation. The closing of a first microswitch means 80*a* activates the motor to run in a first direction, and the jib sheets are pulled in or let out until the switch re-opens when the vane returns to its home orientation relative to the sail. The motor rotates the opposite direction when the second microswitch means 82a is closed by the wind vane. Time delay means 88, 90** are added to filter out brief flutters or even longer in duration displacements of the vane, as desired, to eliminate overly sensitive activations of the motor.

In FIGS. 6 and 7, washers 92 facilitate the swivelling of wind vane 22. Electrical wires 94, 96 which interconnect switches 80, 82 to the motor, may be eliminated by providing a radio transmitter means as a part of switches 80, 82; a receiver means would be provided as a part of the motor in such embodiment.

In another embodiment, shown in FIG. 8, cross bar 28 and feedback members 30, 32 are eliminated. Wind vane 22 is rotatably mounted on a split wind vane holder 100 which has a first rearwardly extending arcuate leg 102 on a first side of sail 12 and a second rearwardly extending arcuate leg 104 on the opposite side of the sail. The holder thus has the general appearance of an elongate clothes pin; the sail is disposed between the legs 102, 104 and the wind vane 22 is rotatably mounted on the head portion 99 of the holder 100 which holder abuttingly and rotatably engages the leading edge 14 of sail 12, as shown. The distal end 103, 105 of leg members 102, 104 are attached to sail 12. This configuration allows information about the sail's angular position to be input into the motor 44 through the potentiometer.

Having described the mechanical construction of the novel apparatus, its operation can now be easily explained.

The sailor first sets the sail in a conventional manner to obtain maximum power from the wind. If the boat is equipped with "telltails," indicated collectively in FIG. 1 by the reference numeral 74, both of which are visible at the same time if the boat is equipped with a plastic window 76 sewn into the sail near the luff, setting the sail for maximum power is a simple matter; the technique of how to use the telltails is widely published and need not be repeated here.

Importantly, when the sail has been positioned as desired, an angle will exist between the wind vane and the sail. This is the initial, operator-determined relative angle. Whenever the wind vane rotates, in response to relative wind shift or course changes, the novel apparatus works to restore the initial operator-determined relative angle between the wind vane and sail.

Once the desired sail position and hence the initial operator-determined relative angle is obtained, the appropriate button 78 on control panel 72 is pushed to energize motor 44. This will set the potentiometer, in effect, to zero or "home" so that motor 44 is not activated.

When the wind changes direction, wind vane 22 will respond instantly. The relative rotation between the resistor and slider of the potentiometer will instantaneously produce an output voltage to drive motor 44. Motor 44 is thus activated to adjust either jib sheet 64 or its counterpart by an amount that corresponds to the amount of angular displacement of the vane 22 away from its home position.

The adjusting of the appropriate jib sheet will in turn affect the angular position of the sail so that maximum power is again derived from the new wind direction.

When the position of the sail 12 is changed, such shift in sail position is communicated to crossbar 28 by feedback members 30, 32 (or 102, 104 in the embodiment of FIG. 8), and such rotation of crossbar 28 returns sleeve 24 to its home position vis a vis wind vane 22, i.e., the slider and resistor are returned to their zero voltage position and motor 44, which need not be an autopilot motor, shuts off.

Thus, feedback members 30, 32 complete a feedback loop; the novel apparatus is thus understood to constitute a servo mechanism. Wind represents the input information for the servomechanism. The wind vane 22 transmits that information to motor 44 which in turn transmits the information to the sail by adjusting the jib sheets, and the information comes full circle when the new sail position is transmitted back to the wind vane via the feedback members so that the "new" position of said wind vane becomes the new "home" position to thereby deactivate motor 44 until new wind information is again input into the servomechanism.

Now that the basic invention has been disclosed, it becomes apparent that motor 44 could be operated with operatoractivated relay switches such as switch means 110 shown in FIG. 9. The use of switch means 110 eliminates the need for the entire wind vane assembly 20, including feedback members 30, 32 and the wind vane 22, but requires the operator to continually observe telltails 74 or to otherwise observe sail conditions on boats not equipped with telltails. Thus, whenever the telltails are not properly aligned or whenever the operator otherwise becomes aware of the need for an adjustment to the sail's trim, the operator displaces toggle switch 112 in the appropriate direction to activate motor 44 to rotate clockwise or counterclockwise to pull in or let out either line 64 or its counterpart. The operator deactivates motor 44 when the desired sail orientation is achieved by returning switch 112 to its center position.

Switch means 110 is a commercially available double pole double throw momentary switch. Lines 114, 114 deliver power from a battery, not shown, to terminals 116, 117, as shown. Lines 118, 119 are wired in crisscross relation as shown to terminals 120, 121 and 122, 123, respectively, as shown, so that selective throwing of switch 112 in either direction as depicted by double-headed directional arrow 124 effects rotation of the output shaft of motor 44 in the desired direction. The jib sheets are thus let in and out as needed just as in the earlier-described embodiments.

Still another variation on the present invention harnesses the telltails to start and stop motor 44, in lieu of wind vane assembly 20 and its related parts.

As depicted in FIG. 10, a telltail 74 has its beating ends fixedly secured to a flexible switch activator bar means 130; when telltail 74 is streaming in the configuration denoted 74, the sail is in its most efficient position. Thus, bar 130 depresses outwardly biased activator means 132, thereby deactivating motor 44 through switch 134. However, when the telltail is in a configuration such as denoted 74a, the sail is not efficiently set. The pull of telltail 74a is not sufficient to overcome the outward bias on activator means 132 and as a result activator 130 assumes position 130a and switch 134 activates motor 44 to rotate a first direction. Another switch means 134 and bar 130, not shown, are provided on the opposite side of the sail and a telltail on said opposite side of the sail controls operation of motor 44 in its opposite direction.

Both switches 134 are conductively coupled to motor 44 through lines 135, 136; a time delay relay means 138 filters out electrical signals resulting from brief fluctuations of the telltails from their respective optimal streaming configurations.

Lines 135, 136 are eliminated by providing a radio transmitter means, not shown, as a part of switch means 134; motor 44 in such embodiment is equipped with a receiving means that responds to transmitted signals.

Still another embodiment of the present invention is shown in FIG. 11. A photoelectric cell 140 is secured to the telltail window and is covered by a flexible cloth flap member 142 whenever telltail 74 is streaming as depicted in FIG. 11. The leading edge of flap 142 is sewn to sail 12. A lightreflective material 141 covers the inside (sail side) surface of flap 142. Thus, in daylight hours, whenever flap 142 is displaced away from its overlying position to sail 140 by telltail 74 being displaced away from its optimal streaming position, the reflective material on the inside surface of flaps 142 directs sunlight onto cell 140 and motor 44 is activated through lines 143, 144. A small spotlight means 146 is provided for nighttime sailing; the inventive parts work in the same way as when the light that activates cell 140 is sunlight. The parts shown in FIG. 11 have unillustrated counterparts on the opposite side of sail 12.

In another, unillustrated embodiment, cell 140 is not covered by a flap 142. Instead, cell 142 provides a target for a light source 146 whenever telltails 74 are streaming in their optimal positions in substantially parallel relation to the sail. When a telltail is out of its optimal position, it blocks radiation source 146 and cadmium cell 140 reacts and instantaneously starts the output shaft of the motor rotating in a first preselected direction, unless suitable time delay circuits are provided to filter out brief disruptions of the radiated beam. The motor continues running until the telltail had resumed its optimal streaming position which again allows radiation to impinge upon cell 140 which event shuts off motor 44. Cells 140 on opposite sides of sail 12 effect opposite rotation of the motor's output shaft. This arrangement also eliminates the wind vane assembly and the feedback members.

INDUSTRIAL APPLICABILITY

The sailboat industry is important to the world's economy. By providing an apparatus that will make both pleasure sailing and competitive sailing more enjoyable, this invention will help stimulate the sailboat and related industries.

This invention represents a technological breakthrough in the art of "automatic" sail trimming devices; it is a pioneering invention. Accordingly, the claims appended hereto are entitled to broad interpretation, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus that substantially maintains a preselected angular orientation of a sail on a sailboat, comprising:

a sail;

said sail having leading ends of a pair of transversely spaced, longitudinally extending flexible lines connected thereto;

a pair of line mounting means for securing trailing ends of each of said lines;

said lines operative to control the angular orientation of said sail;

said sail having a first preselected position determined by an operator of said sailboat;

a wind vane means;

said wind vane means and said sail defining an initial relative angle therebetween when said sail is in its first preselected position;

a motor means electrically connected to said wind vane means;

said motor means being activated when the initial relative angle between said wind vane means and said sail is changed to a different relative angle;

said motor means being operably connected to said lines that control the angular orientation of the sail;

feedback means connected between said sail and said wind vane means;

said feedback means including a wind vane assembly upon which said wind vane means is mounted; and a pair of elongate feedback members, each of which has a leading end connected to opposite sides of said wind vane assembly and a trailing end connected to opposite sides of said sail so that angular movement of said sail is communicated to said wind vane assembly to restore said initial relative angle;

said motor means being deactivated when said feedback means indicates to said motor means that the initial relative angle between the sail and wind vane means has been restored by the operation of said motor means.

2. The apparatus of claim 1, wherein said wind vane assembly includes a transversely disposed crossbar member having opposite ends to which different members of said feedback members are secured.

3. The apparatus of claim 1, further comprising a pair of transversely disposed flexible lines connected to different members of said pair of longitudinally extending lines substantially mid-length thereof.

4. The apparatus of claim 3, wherein said motor means is positioned substantially mid-length of longitudinally extending, parallel portions of said longitudinally extending flexible lines, and substantially intermediate said lines.

5. The apparatus of claim 4, further comprising a speed reducer means, driven by said motor means, having an output shaft means.

6. The apparatus of claim 5, wherein said transversely disposed flexible lines have their innermost ends secured to said output shaft means of said speed reducer means, said innermost ends being disposed in coiled relation to said output shaft means, whereby activation of said motor means shortens or lengthens the effective extent of said transverse lines which in turn affects said longitudinally extending lines and hence the position of said sail.

7. A feedback apparatus that monitors wind conditions and adjusts the angular position of a sailboat's sail accordingly, comprising:

a wind vane assembly that has an equilibrium position, relative to a sail, that is determined by the operator of the sailboat;

a motor means that is activated whenever said wind vane assembly is displaced by wind from its equilibrium position;

said motor means operative to return said wind vane assembly to its equilibrium position relative to said sail by moving said sail when activated;

feedback means that communicates the angular position of said sail to said wind vane assembly;

a pair of elongate, longitudinally extending flexible line members that are transversely spaced apart from and parallel to one another, each of said lines having a leading end secured to a sail and a trailing end secured to a winch means and said line members being operative to change the sail's position, said motor means being operatively connected to each of said lines so that activation of said motor means changes the angular position of said sail;

a pair of transversely extending flexible line members that operatively connect said longitudinally extending line members and said motor means; and a speed reducer means operatively connected to said motor means, said speed reducer means including at least one longitudinally aligned output shaft member about which innermost ends of said transversely disposed lines are wrapped.

8. The apparatus of claim 7, wherein said motor means is positioned substantially centrally of said sailboat, mid-length of parallel portions of said longitudinally extending lines.

9. The apparatus of claim 8, wherein said wind vane assembly includes a wind vane means and a rotatably mounted "T"-shaped mounting means for said wind vane means.

10. The apparatus of claim 9, wherein said feedback means includes a pair of elongate feedback members each of which has a trailing and a leading end, said feedback members being disposed on opposite sides of said sail, the leading ends of said feedback members being secured to opposite ends of a crossbar portion of said "T"-shaped mounting means, and the trailing ends of said feedback members being secured to opposite sides of said sail so that a change in angular position of said sail is simultaneously transmitted to said wind vane assembly by said feedback members whereby said motor means is deactivated when the wind vane means is restored to its equilibrium position relative to the sail.

11. An automatic sail trimmer, comprising:

a wind vane means;

a motor means disposed substantially mid-length of a sailboat, substantially centrally thereof;

a sail mounted for rotation about a substantially vertical axis in a horizontal plane;

a pair of longitudinally extending, flexible line members each of which has a leading end secured to said sail;

said line members being disposed in substantial parallelism to each other on opposite, transversely spaced apart sides of said sailboat;

transversely spaced apart securing means for securing trailing ends of each of said line members;

a speed reducer means operatively connected to said motor means;

said speed reducer means having at least one longitudinally aligned output shaft;

a pair of oppositely extending, transversely disposed flexible line members disposed in interconnecting relation to said longitudinally extending line members and said at least one output shaft so that innermost ends of said transversely disposed line members are coiled about said output shaft;

a rotatably mounted wind vane assembly means for mounting said wind vane means;

said wind vane assembly means including a transversely disposed crossbar member positioned forwardly of said sail;

a pair of feedback members having their leading ends secured to opposite ends of said crossbar member;

said feedback members having trailing ends secured to opposite sides of said sail so that said crossbar member and said feedback members form an isosceles triangle configuration where the crossbar member is the base thereof and the feedback members are the sides thereof;

said wind vane means and said sail having a first equilibrium relative angular position therebetween determined by an operator of said sailboat;

said wind vane means operatively connected to said motor means such that said motor means is deactivated when said sail and wind vane means are in said first relative angular position and so that said motor means is activated when said wind vane means and sail are not angularly disposed in said first relative angular position;

a control means for said motor means;

whereby the operator of the sailboat manually disposes the sail in a desired angular position in relation to said wind vane means and manually activates said control means to thereby define said desired position as the relative angular position of said sail and wind vane means;

said motor means restoring said sail to its desired angle relative to said wind vane means when said wind vane means is desired by wind.

12. An apparatus that adjusts the angular orientation of a sail in response to changes in relative wind, comprising:

a sail having respective forward ends of transversely spaced, longitudinally extending flexible lines connected thereto;

each of said flexible lines having respective rearward ends secured to a line mounting means;

said flexible lines disposed in substantial parallelism with one another;

a motor means;

a pair of transversely disposed flexible lines disposed in interconnecting relation between said parallel flexible lines and said motor means;

a telltail means, a photoelectric cell means, and a radiation source means operative to activate said motor means when the angular orientation of said sail relative to wind is such that the sail is operating below a preselected threshold of efficiency and operative to deactivate said motor means when the angular orientation of said sail relative to wind is such that the sail is operating above said preselected threshold of efficiency;

activation of said motor means operative to adjust the angular orientation of said sail by acting upon said parallel flexible lines through said transversely disposed flexible lines;

sail position feedback means to provide information concerning the instantaneous position of said sail to said telltail means, photoelectric cell means and radiation source means, so that when said sail is placed into a position where its efficiency is above said preselected threshold of efficiency, said motor means is deactivated;

said cell means being operative to deactivate said motor means when radiation from said radiation source means is impinging upon said cell means and wherein said cell means is operative to activate said motor means when radiation from said radiation source means is not impinging upon said cell means as when a telltail is blown into blocking relation between said radiation source means and said cell means.

13. The apparatus of claim 12, further comprising time delay means operative to prevent transient fluctuations of said telltail means having a time duration below a preselected amount of time from activating said motor means.

14. The apparatus of claim 12, wherein said wind information input means includes switch means operated by a human operator.

15. The apparatus of claim 12, wherein said wind information input means includes a pair of microswitch means mounted on opposite sides of said sail, said microswitch means being electrically connected to said motor means, means to close a microswitch means when said sail is angularly displaced away from a preselected optimal angular orientation with respect to relative wind, and time delay means to prevent activation of said motor means for periods of time shorter than a preselected period of time.

16. An apparatus that substantially maintains a preselected angular orientation of a sail on a sailboat, comprising:

a sail;

a first flexible line connected to a first side of said sail;

a second flexible line connected to a second side of said sail;

a first part of said first flexible line being disposed transverse to a longitudinal axis of symmetry of said sailboat;

a first part of said second flexible line being disposed transverse to a longitudinal axis of symmetry of said sailboat;

said respective first parts of said first and second flexible lines extending in opposite directions from said sail;

a second part of said first flexible line being disposed parallel to said longitudinal axis of symmetry of said sailboat;

a second part of said second flexible line being disposed parallel to said longitudinal axis of symmetry of said sailboat;

a pair of line mounting means for securing trailing ends of said first and second lines;

said first and second lines operative to control the angular orientation of said sail;

said sail having a first preselected position determined by an operator of said sailboat;

a wind vane means;

said wind vane means and said sail defining an initial relative angle therebetween when said sail is in its first preselected position;

a motor means electrically connected to said wind vane means;

said motor means being activated when the initial relative angle between said wind vane means and said sail is changed to a different relative angle;

said motor means being operably connected to said first and second lines that control the angular orientation of the sail;

feedback means connected between said sail and said wind vane means;

said motor means being deactivated when said feedback means indicates to said motor means that the initial relative angle between the sail and wind vane means has been restored by the operation of said motor means.

17. The apparatus of claim 16, wherein said feedback means includes a wind vane assembly upon which said wind vane means is mounted, and a pair of elongate feedback members each of which has a leading end connected to opposite sides of said wind vane assembly and a trailing end connected to opposite sides of said sail so that angular movement of said sail is communicated to said wind vane assembly to restore said initial relative angle.

18. The apparatus of claim 16, wherein said wind vane assembly includes a transversely disposed crossbar member having opposite ends to which different members of said feedback members are secured.

19. The apparatus of claim 16, further comprising a first and second transversely disposed flexible line connected to said first and second longitudinally extending lines, substantially mid-length thereof, respectively.

20. The apparatus of claim 19, wherein said motor means is positioned substantially mid-length of longitudinally extending, parallel parts of said first and second longitudinally extending flexible lines, and substantially intermediate said first and second lines.

21. The apparatus of claim 20, further comprising a speed reducer means, driven by said motor means, having an output shaft means.

22. The apparatus of claim 21, wherein said transversely disposed flexible lines have their innermost ends secured to said output shaft means of said speed reducer means, said innermost ends being disposed in coiled relation to said output shaft means, whereby activation of said motor means shortens or lengthens the effective extent of said transverse lines which in turn affects said first and second longitudinally extending lines and hence the position of said sail.

* * * * *